United States Patent [19]

Kodaira

[11] Patent Number: 4,567,806

[45] Date of Patent: Feb. 4, 1986

[54] SOUND GENERATOR

[75] Inventor: Mitsuharu Kodaira, Suwa, Japan

[73] Assignee: Kabushiki Kaisha Suwa Seikosha, Tokyo, Japan

[21] Appl. No.: 530,138

[22] Filed: Sep. 7, 1983

[30] Foreign Application Priority Data

Sep. 9, 1982 [JP] Japan ..... 57-156940

[51] Int. Cl.[4] ..... G10H 1/02

[52] U.S. Cl. ..... 84/1.26; 84/1.13; 340/384 E; 368/255

[58] Field of Search ..... 340/384 E; 84/1.26, 84/1.13; 368/255

[56] References Cited

U.S. PATENT DOCUMENTS 4,095,502 6/1978 Moore et al. ..... 84/1.26
4,250,787 2/1981 Segan et al. .
4,397,211 8/1983 Ferdinand ..... 84/1.26

FOREIGN PATENT DOCUMENTS 56-79987 6/1981 Japan ..... 368/255

OTHER PUBLICATIONS

Folwell, "Novelty Bleeper Doorbell", Practical Electronics, Apr. 1979, pp. 38–39.

*Primary Examiner*—Forester W. Isen
*Attorney, Agent, or Firm*—Blum, Kaplan, Friedman, Silberman & Beran

[57] ABSTRACT

The sound generator applies an envelope to the note signal. Current to the sound producing element is controlled by a series transistor whose base is driven with a signal having a frequency corresponding to the musical note. The driving voltage applied to the base has a voltage amplitude corresponding to the voltage stored in a capacitor connected through a resistor and discharging through said resistor and the base of the transistor controlling the current to the sound producer.

10 Claims, 12 Drawing Figures

SOUND GENERATOR

BACKGROUND OF THE INVENTION

This invention relates generally to a sound generator of the type used to electronically produce musical sound and more particularly to a sound generator applying an envelope to musical output signals so as to reproduce the characteristics and the sound of a particular instrument. In the prior art, an envelope has been applied to the output signals for driving a speaker, such as a piezo-electric buzzer, by gradually reducing the duty ratio of the frequency signal applied for driving a speaker. Thereby, the average current flowing through the speaker is gradually reduced to decrease sound pressure and an envelope is applied to the sound signal. A large number of circuit elements are required in the method varying the duty ratio so that ciost of such a product increases substantially. Even in an integrated circuit the increased unit cost for the integrated circuit due to an enlargement of the chip is substantial and is greater that the cost of parts and the cost of assembling the individual parts.

What is needed is a sound generator which applies a desired envelope to the sound signals in a small and economical construction of few electronic components.

SUMMARY OF THE INVENTION

Generally speaking, in accordance with the invention, a sound generator which applies an envelope to the output signal is provided. Current to the sound producing element is controlled by a series transistor whose base is driven with a signal having a frequency corresponding to the musical note. The driving voltage applied to the base has a voltage amplitude corresponding to the voltage stored in a capacitor connected through a resistor and discharging through said resistor and the base of the transistor controlling the current to the sound producer.

Accordingly, it is an object of this invention to provide an improved sound generator having an output signal which is modulated with an envelope to simulate a desired instrument.

Another object of this invention is to provide an improved sound generator which applies an envelope to the output sound signal using few components.

A further object of this invention is to provide an improved sound generator which allows for mixing of notes from two sound sources, the notes from each sound source having an envelope applied thereto to simulate a desired musical instrument.

Still other objects and advantages of the invention will in part be obvious and will in part be apparent from the specification.

The invention accordingly comprises the features of construction, combination of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 8:
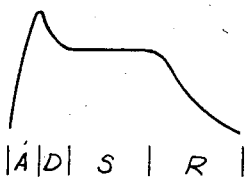
FIG. 8 illustrates a typical envelope waveform of a musical sound signal.
Figure 9:
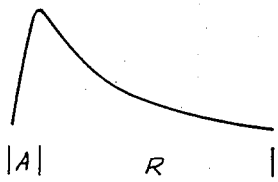
FIG. 9 illustrates an envelope waveform of the AR-type.

This invention relates generally to a technique for adding an envelope to a sound signal outputted from a sound generator having a high direct current impedance, such as a piezo-electric buzzer or electromagnetic buzzer. An envelope waveform for a sound is generally comprised of identifiable portions, namely, attack, decay, sustenance and release as illustrated in FIG. 8. However, in a sound produced by a piano, the envelope waveform is comprised only of the attack (A) and release (R) portions, that is, an AR-type envelope as shown in FIG. 9. Decay and sustenance portions are not reproduced. It is well known that a sound signal with a AR-type envelope simulates a piano with a nearly natural sound.

Figure 10:
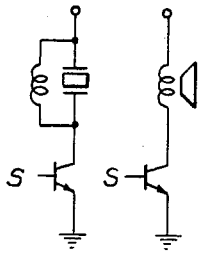
FIG. 10 PRIOR ART
FIG. 10 illustrates driving circuits for sound generators of the prior art.

When using a sound producer having a high direct current impedance such as a piezo-electric buzzer or an electromagnetic buzzer, as illustrated in FIG. 10, the sound producer is interposed between a power supply and an end of the collector of a bipolar transistor, biased to common emitter, and outputs a sound signal having a fixed frequency in response to a signal S applied to the base. However, in the circuit constructions of FIG. 10, it is not possible to add an envelope to the sound signal outputted from the sound producer by applying a signal with an AR-type envelope (FIG. 2) to the base because this circuit is a current amplification circuit.

Figure 11:
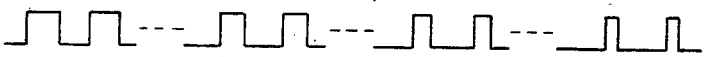
FIG. 11, illustrates waveforms and sound signals wherein the duty ratio is gradually varied to produce a sound envelope.

In the prior art, as shown in FIG. 11, signals having a fixed period but with a gradually decreasing duty ratio are applied to the base. Then, the average current flowing through the sound producer gradually decreases to reduce the sound pressure output. Thus an envelope is applied to the sound signal which provides a natural sound. However, this method requires a circuit for gradually decreasing the duty ratio of the waveform and it is necessary to vary duty at a one to one ratio according to the period of the musical interval of the sound signals produced. Therefor, the circuit construction is extremely complicated when it is desired to apply a smoothly tapered envelope to the sound signal output.

Figure 12:
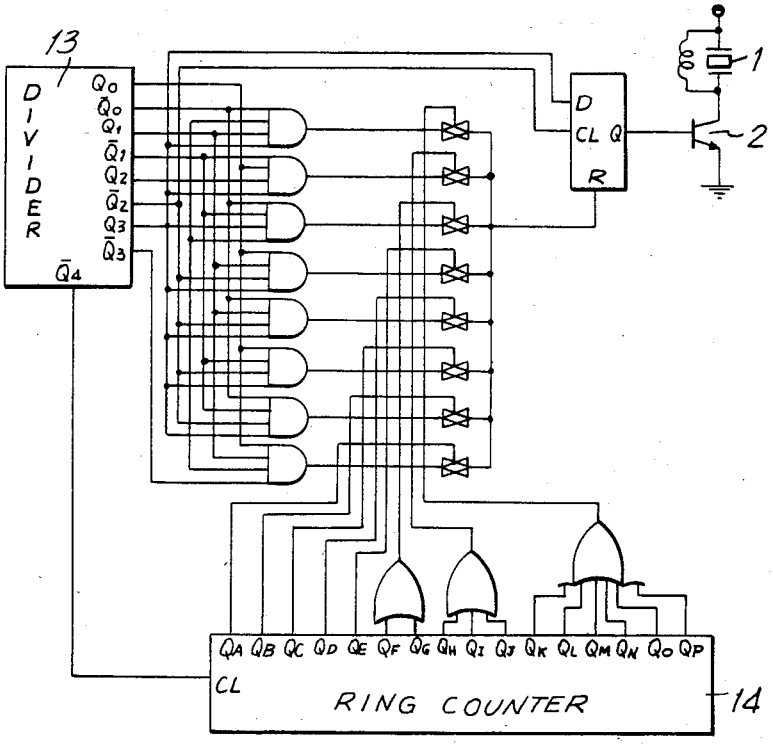
FIG. 12 illustrates a circuit for stepwise variation of the duty ratio.

Further, if a digital circuit is utilized in this situation, the duty ratio doesn't change linearly but changes in small steps. Increasing the number of these steps for obtaining a sound with a natural tapered envelope, results in a much larger and more complex circuit construction. FIG. 12 is a circuit for varying the duty ratio stepwise as stated above. Therein, variation of duty ratio is made in eight steps by using a divider 13 having 13 stages and a ring counter 14 with 16 stages. As many as 700 elements are required for constructing a circuit FIG. 12.

Figure 1:
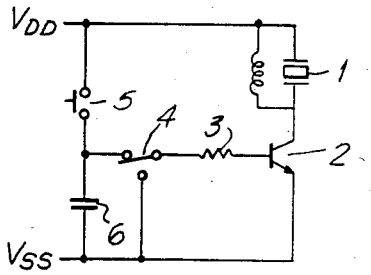
FIG. 1 is a circuit in accordance with the invention for applying envelopes to sound signals.
Figure 2:
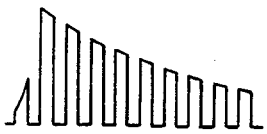
FIG. 2 is a sound signal with an envelope.

In order to eliminate the above disadvantages, a simple circuit construction is used to apply an envelope to a sound signal. A detailed description of a circuit embodiment in accordance with the invention is now described with reference to FIG. 1. Therein, a piezo-electric buzzer 1 is used as a sound producer and an NPN transistor 2 biased common emitter is used as the element for driving the sound producer 1. A capacitor 6 is charged by closing a second switch 5 and after opening the switch 5, the electrical charge which has accumulated in the capacitor is discharged through the first switch 4, a resistor 3, the base of the bipolar transistor 2 and its emitter in turn. When the first switch cycles on and off continuously relative to the frequency of the musical interval of sound signal which will be generated, the piezo-electric buzzer 1 is driven by a sound signal with an AR-type envelope as shown in FIG. 2. This envelope substantially shows the charge and discharge curve of the capacitor 6.

If the on impedance of the second switch is much less than the resistance of the resistor 3, the voltage charged into the capacitor comes to be almost equal to the supply voltage.

Figure 3:
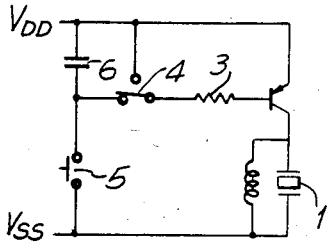
FIG. 3 is an alternative embodiment of a circuit for applying envelopes to sound signals in accordance with the invention.

A circuit construction wherein a PNP transistor is utilized instead of the NPN transistor, is illustrated in FIG. 3. Performance is the same for sound reproduction. Further, when an electromagnetic buzzer is utilized for the sound producer instead of a piezo-electric buzzer, the coil illustrated in FIGS. 1 and 3 in parallel with the piezo-electric buzzer 1 and the piezo-electric buzzer 1 are replaced by the electromagnetic buzzer.

Figure 4:
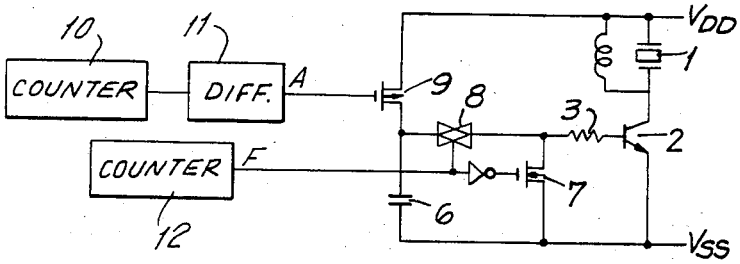
FIG. 4 is a sound generating circuit in accordance with the invention for producing a melody.
Figure 5:
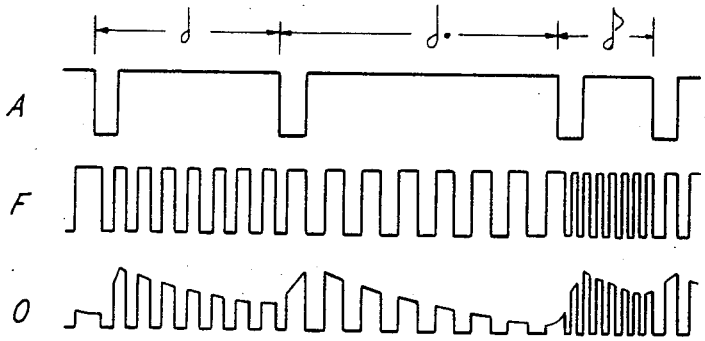
FIG. 5 illustrates timing charts showing waveforms at various points in the circuit of FIG. 4.

This is the fundamental principal of applying an envelope to a sound signal in accordance with this invention. FIG. 4 is a circuit for outputting a melody using a circuit construction as illustrated in FIG. 1. The counter 10 determines the length of each musical note and outputs signals in succession having a duration corresponding to the various musical notes in the melody. In response to the output of the counter 10, a differentiation circuit 11 outputs a negative pulse A with a fixed pulse width at the beginning of each musical note as illustrated in FIG. 5. A transistor 9 corresponds to the second switch 5 of FIG. 1 and is turned on during the time when the negative pulse A is applied to the transistor gate, and is turned off during the time when the pulse A is at the high level.

A transmission gate 8 and a N channel transistor 7 correspond to the first switch 4 in FIG. 1. A counter 12 outputs a frequency signal in accordance with each musical note. When the output signal F of the counter 12 is high, the transmission gate 8 is turned on and the transistor 7 is turned off as a result of the inverter between the counter 12 and transistor 7. When the output signal F is low, the transmission gate 8 is turned off and the transistor 7 is turned on. As a result, in accordance with the duration of the selected musical note, that is, the interval between pulses of the signal A, and at a fixed musical interval, that is, the period of the frequency signal F, the piezo-electric buzzer 1 is driven by a sound signal with envelopes as depicted in curve O in FIG. 5. As illustrated, the envelope tapers with a RC characteristic such that notes of longer duration, that is, more time between the pulses A, diminish to a lower level with time then do notes of shorter duration. The initial amplitude is the same in each case and the frequencies of the signals remain true to the selected notes.

In a melody-producing sound generator in accordance with this invention as illustrated in FIGS. 4 and 5, only a few circuit elements such as the differentiation circuit 11, transistors 7–9, capacitor 6 and resistor 3 are additionally required over the elements of the prior art, that is, in addition to elements such as the counter 10, which determines the length of the musical notes, counter 12 which determines the frequency of the musical notes, sound producer 1 and the bipolar transistor 2. Therefore, this invention clearly provides a very simple circuit construction for applying envelopes to a sound signal, wherein the number of circuit elements is greatly reduced as compared to a conventional melody producing system as illustrated in FIG. 12 operating on the principle of varying the duty ratio.

In an alternative embodiment in accordance with the invention, it is possible to obtain a sound signal with envelopes using the on impedance of the first transistor by directly connecting the first switch to the base of the transistor without using a resistor 3.

Figure 6:
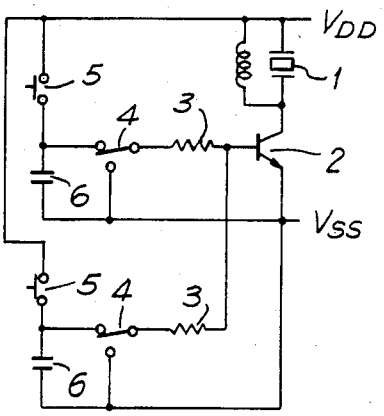
FIG. 6 is a circuit similar in concept to that of FIG. 1 for applying envelopes to the signals from two sound sources.

In the circuit embodiments described above with reference to FIGS. 1–5, only one sound source is utilized. However, the simple circuit construction of this invention can also be applied to a plurality of sound sources for producing harmonic sounds or overlapped sound. FIG. 6 shows an alternative embodiment, and a pair of circuits of the same construction of that of FIG. 1, are provided corresponding to the respective sound sources. A single sound producer 1 and a single bipolar transistor 2 for driving the sound producer 1 are sufficient in this circuit. Therein, each resistor 3 not only operates as a path of discharge current from the capacitors but also the sound signals from the two sound sources are mixed together.

Figure 7:
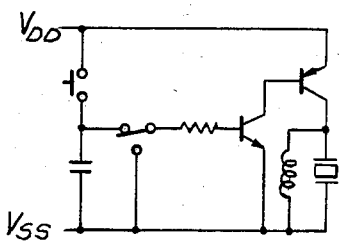
FIG. 7 is an alternative embodiment of a circuit for applying envelopes to sound signals in accordance with the invention.

The tapered envelope applied to the sound signal in accordance with the invention is determined by the time constant of the capacitor 6 in combination with the resistor 3. But base current of the bipolar transistor 2 is restricted by the value of the resistor so there is a possibility that sound pressure from the sound producer 1 in insufficient when the value of the resistor 3 is large. In this case, as illustrated in FIG. 7, an additional bipolar transistor is provided to amplify the current, resulting in an increase of the driving current of the bipolar transistor for driving the sound producer. Therefor, a dynamic speaker having a direct current impedance of 8 ohms, as well as an electromagnetic buzzer of high impedance, can be applied to the sound producer.

As stated above, a sound generator in accordance with this invention makes possible an improved musical tone quality which produces a sound signal with a smooth and natural envelope using a simple circuit construction.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawing(s) shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A sound generator for driving an acoustic transducer with signals having a shaped envelope, comprising:

at least one sound source outputting a frequency signal corresponding to the tone of a desired sound;

a bipolar transistor biased common emitter in series with said acoustic transducer across a voltage source, said acoustic transducer being connected between the collector of said transistor and one terminal of said voltage source, the emitter of said transistor being connected to the other terminal of said voltage source;

a capacitor and first switch means in series between said emitter and the base of said transistor, one terminal of said capacitor being connected to said emitter, said first switch means being adapted to open and close in synchronism with said frequency signal corresponding to said tone;

second switch means in series with said capacitor across said voltage source, said second switch means being connected between said first switch means and the other terminal of said capacitor, said capacitor charging through said second switch means when said second switch means is closed and discharging exclusively through said first switch means and transistor base when said first switch means is closed, said transducer being driven with pulses having a frequency corresponding to said tone, said pulses having an envelope corresponding to the RC circuits for charging and discharging said capacitor, said discharge circuit including the base/emitter resistance of said transistor.

2. A sound generator as claimed in claim 1 and further comprising means for closing said second switch means at the initiation of said tone, said second switch means being closed for only a portion of the duration of said tone, said envelope decaying when said second switch means is reopened.

3. A sound generator as claimed in claim 1, and further including a resistor in series with said first switch means, said capacitor and the base/emitter resistance of said transistor.

4. A sound generator as claimed in claim 2, wherein said at least one sound source outputs a plurality of signals of different frequencies corresponding to different tones in a selected sequence, said at least one sound source controling the duration of each said tone, said second switch means closing for an interval at the initiation of each tone.

5. A sound generator as claimed in claim 1, wherein said acoustic transducer is one of an electro-magnetic device and a piezo-electric device.

6. A sound generator as claimed in claim 5, wherein the number of said sound sources is at least two, each sound source having first switch means and second switch means, a capacitor and resistance respectively associated therewith and connected together and to said transistor and said voltage source, each said capacitor discharging through the associated resistance and associated first switch means to said base of said bipolar transistor, said acoustic transducer producing sounds from each sound source concurrently, with mixing and applied envelopes.

7. A sound generator as claimed in claim 2, wherein said second switch means includes a transistor and said first switch means includes a transmission gate.

8. A sound generator as claimed in claim 5, wherein said second switch means includes a transistor and said first switch means includes a transmission gate.

9. A sound generator for driving an acoustic transducer with signals having a shaped envelope, comprising:

at least one sound source outputting a frequency signal corresponding to the tone of a desired sound;

a bipolar transistor biased common emitter in series with said acoustic transducer across a voltage, said acoustic transducer being connected to the collector of said transistor;

a capacitor connected to the base of said transistor at one end and to the collector of said transistor at the other end;

means for charging said capacitor;

means for opening and closing a discharge path for said capacitor exclusively through said base of said transistor, said discharge path being interrupted at a frequency corresponding to the frequency of the tone to be generated, said acoustic transducer being driven with pulses having a frequency corresponding to said tone, said pulses having an envelope corresponding to the RC discharge circuit of said capacitor through the base/emitter resistance of said transistor.

10. A sound generator as claimed in claim 9 and further including a resistor in series with said capacitor across the emitter/base terminals of said transistor, said RC discharge circuit including said resistor and said base/emitter resistance in series.

* * * * *